US011705321B2

(12) United States Patent
Lau et al.

(10) Patent No.: US 11,705,321 B2
(45) Date of Patent: Jul. 18, 2023

(54) ELECTRODELESS PLASMA LAMPS, TRANSMISSION LINES AND RADIO FREQUENCY SYSTEMS

(71) Applicant: TOPANGA ASIA LIMITED, Kowloon (HK)

(72) Inventors: Eddie Koon Chung Lau, North Point (HK); Wing Yiu Lam, New Territories (HK); Yuen Fat Lee, Kowloon (HK)

(73) Assignee: TOPANGA ASIA LIMITED, Hong Kong (CN)

( * ) Notice: Subject to any disclaimer, the term of this patent is extended or adjusted under 35 U.S.C. 154(b) by 0 days.

(21) Appl. No.: 16/898,729

(22) Filed: Jun. 11, 2020

(65) Prior Publication Data

US 2020/0395208 A1 Dec. 17, 2020

(30) Foreign Application Priority Data

Jun. 12, 2019 (HK) ..... 19125091.9

(51) Int. Cl.
*H01J 65/04* (2006.01)
*H01P 3/06* (2006.01)

(52) U.S. Cl.
CPC ..... *H01J 65/042* (2013.01); *H01P 3/06* (2013.01)

(58) Field of Classification Search
CPC ..... H05B 41/24; H05B 41/2806; H01J 9/18; H01J 9/26; H01J 65/042; H01J 65/044
See application file for complete search history.

(56) References Cited

U.S. PATENT DOCUMENTS

| | | | | |
|---|---|---|---|---|
| 5,821,698 | A * | 10/1998 | Lapatovich | H01J 65/042 315/248 |
| 6,362,565 | B1 * | 3/2002 | Katase | H01J 61/125 313/485 |
| 6,922,021 | B2 | 7/2005 | Espiau et al. | |
| D612,093 | S | 3/2010 | Espiau et al. | |
| 7,830,092 | B2 | 11/2010 | Espiau et al. | |
| 8,154,216 | B2 | 4/2012 | Espiau et al. | |
| 8,179,047 | B2 | 5/2012 | Espiau et al. | |
| 8,283,866 | B2 | 10/2012 | Espiau et al. | |
| 8,294,368 | B2 | 10/2012 | Espiau et al. | |
| 8,344,624 | B2 | 1/2013 | Espiau et al. | |

(Continued)

FOREIGN PATENT DOCUMENTS

| | | | |
|---|---|---|---|
| CN | 102084724 | A | 6/2011 |
| CN | 202285229 | U | 6/2012 |

(Continued)

*Primary Examiner* — Tung X Le
(74) *Attorney, Agent, or Firm* — George G. Wang; Bei & Ocean

(57) ABSTRACT

A transmission line for conveying a radio frequency (RF) signal between a first terminal and a second terminal. The transmission line comprises an inner conductor, a middle conductor and an outer conductor. The inner conductor comprises a length of conductive material having a first end for electrical connection with the first terminal and a second end for electrical connection with the second terminal. The middle conductor surrounds at least a part of the length of the inner conductor and is electrically connected to the electrical ground of the source. The outer conductor surrounds at least a part of the length of the middle conductor and is electrically connected to the electrical ground of the load.

20 Claims, 7 Drawing Sheets

(56) References Cited

U.S. PATENT DOCUMENTS

| | | | | |
|---|---|---|---|---|
| 8,525,412 | B2 | 9/2013 | Espiau et al. | |
| 8,525,430 | B2 | 9/2013 | Brockett et al. | |
| 8,766,539 | B2 | 7/2014 | Espiau et al. | |
| 8,884,518 | B2 | 11/2014 | Espiau et al. | |
| 9,640,380 | B1 | 5/2017 | Brockett et al. | |
| 9,754,777 | B1 | 9/2017 | Matloubian et al. | |
| 9,761,433 | B1 | 9/2017 | Brockett et al. | |
| 9,805,925 | B1 | 10/2017 | Brockett et al. | |
| 9,875,887 | B1 | 1/2018 | Brockett et al. | |
| 10,006,607 | B1 | 6/2018 | Brockett et al. | |
| 2007/0085487 | A1 | 4/2007 | Kuennen et al. | |
| 2008/0054813 | A1* | 3/2008 | Espiau | H01J 65/044 315/111.21 |
| 2012/0176029 | A1 | 7/2012 | Doughty | |
| 2012/0217871 | A1* | 8/2012 | Lapatovich | H01J 65/044 315/34 |
| 2013/0082594 | A1* | 4/2013 | Fox | H01J 25/50 315/39.51 |
| 2014/0125225 | A1 | 5/2014 | Calame et al. | |
| 2017/0309433 | A1* | 10/2017 | Williams | H01J 49/26 |

FOREIGN PATENT DOCUMENTS

| | | | |
|---|---|---|---|
| CN | 102856160 | A | 1/2013 |
| CN | 103650104 | A | 3/2014 |
| EP | 2 289 288 | B1 | 9/2013 |

* cited by examiner

ELECTRODELESS PLASMA LAMPS, TRANSMISSION LINES AND RADIO FREQUENCY SYSTEMS

TECHNICAL FIELD

The present application is directed to electrodeless plasma lamps, transmission lines and radio frequency systems including transmission lines.

BACKGROUND OF THE INVENTION

An electrodeless plasma lamp is a lighting device in which an electric or magnetic field transfers the power required to generate light from outside the lamp to gas inside the lamp. For example, a radio frequency signal may be transmitted into the lamp to excite a plasma within a transparent or translucent bulb. Electrodeless plasma lamps may have a relatively long lamp life and high energy efficiency compared to fluorescent lamps and other conventional lighting devices. The radio frequency signal may be transmitted from a radio frequency signal source to the lamp via a transmission line.

Conventional transmission lines include coaxial cable, microstrip lines, strip lines and coplanar waveguides etc and comprise a signal conductor and a ground conductor separated by an air gap or dielectric material. This structure helps to confine the high frequency signal near the transmission line and reduces or minimises losses to the external environment. In a coaxial cable the signal conductor is an inner conductor and the ground conductor is an outer conductor which may surround the inner conductor.

FIG. 1 shows a circuit diagram 100 of a transmission line 110 connecting a source 120 and a load 130. The source 120 in FIG. 1 produces a signal Vs and has an internal impedance $Z_S$, the transmission line has an impedance Zo and the load has an impedance $Z_L$. FIG. 2 shows a conventional design 200 in which the transmission line 210 is a coaxial cable connecting the source 220 and the load 230. The coaxial cable comprises an inner conductor 214 and an outer conductor 212. The outer conductor 212*e* extends all the way from the source 220 to the load 230 and is in electrical contact with the electrical ground of the source and the electrical ground of the load. The inner conductor extends all the way from the source to the load and is in electrical contact with a signal terminal of the radio frequency (RF) driver 224 of the source and a signal terminal of the resistive load 234. The RF driver 224 may transmit a RF signal via an amplifier 226 of the source to the inner conductor 214 of the coaxial cable.

The mechanical dimension of the outer conductor is relatively larger in size as compared to the inner conductor (which is the signal carrying element) and therefore the outer conductor will usually have high thermal conductivity. However, high thermal conductivity of a transmission line gives rise to the problem of undesired heat and noise propagation between the source and the load. For example, in the application of high frequency electrodeless high intensity discharge (HID) systems, the light conversion module converts the high frequency energy into light and heat energy. At the same time, the excessive amount of heat would spread through the ground structure, affecting back to the high frequency source, heating up the electrical component in the radio frequency source (sometimes referred to as the RF driver), and thus negatively affect the performance of the RF driver. Further high temperatures or high electrical disturbances (e.g. a surge from a thunderstorm) could be picked up by the outer conductor and transmitted back to the RF driver causing damage to the RF driver.

SUMMARY

The present disclosure proposes a transmission line comprising an inner conductor, a middle conductor and an outer conductor. The inner conductor electrically connects the source and the load. The middle conductor surrounds the inner conductor and is electrically connected to the electrical ground of the source. The outer conductor surrounds the middle conductor and is electrically connected to the electrical ground of the load. In this way a radio frequency signal propagated by the RF source into the inner conductor may be confined within the transmission line by the middle conductor and/or the outer conductor. However, as the middle conductor is not directly connected to the load, thermal energy is not conducted directly back from the load to the RF source. Further, as the outer conductor surrounds the middle conductor, the middle conductor and thus the RF source are shielded from electrical and thermal disturbances in the external environment.

BRIEF DESCRIPTION OF THE DRAWINGS

The above and other features of the present disclosure, its nature and advantages will be apparent upon consideration of the following description and with reference to embodiment(s) depicted in the accompanying drawings, in which.

DETAILED DESCRIPTION OF THE PREFERRED EMBODIMENTS

In the context of this disclosure the term radio frequency (RF) should be interpreted to mean between 20 KHz and 300

GHz. The phrase "A surrounds B" or similar expressions should be interpreted to mean that A encloses or encircles at least part of B. The phrase "A connects with B" or similar expressions should be interpreted to mean either a direct electrical connection between A and B or an indirect electrical connection via one or more intermediate conductors. The term "terminal" should be interpreted to include a device at an end of a transmission line. The term "insulating" should be interpreted to mean electrically and/or thermally insulating and similar expressions should be interpreted similarly. The terms "substantially the whole", "substantially the entire" or "substantially all" refer to at least 80% of the quantity identified, unless indicated otherwise.

Figure 1:
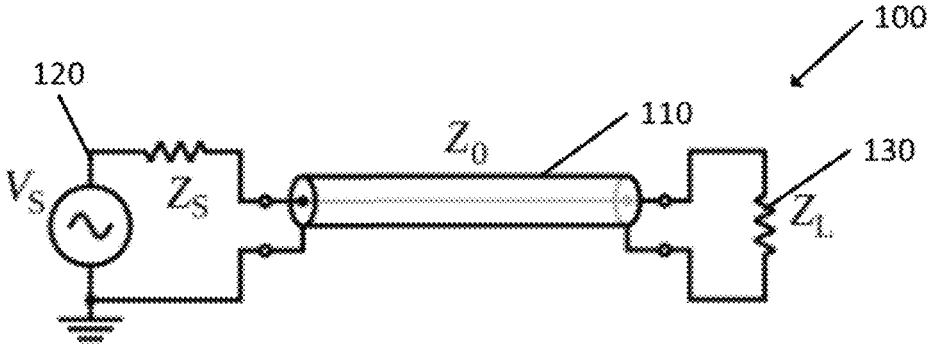
FIG. 1 shows a circuit diagram of a transmission line.
Figure 2:
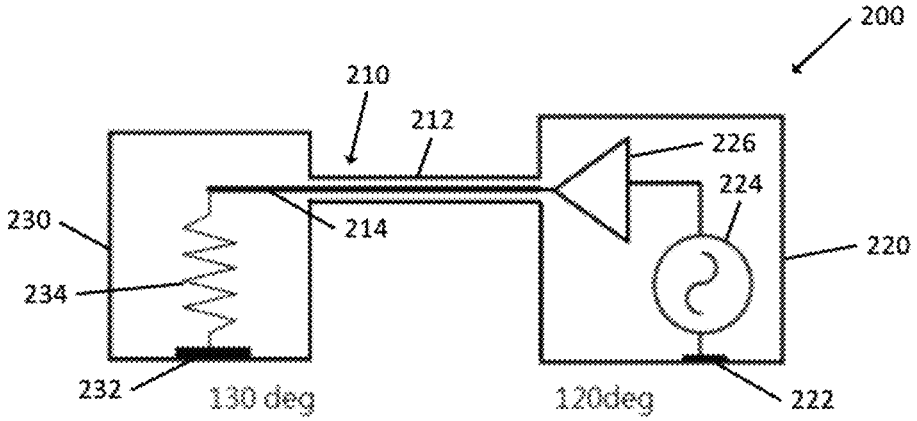
FIG. 2 shows a prior art transmission line connecting a source and a load.
Figure 3:
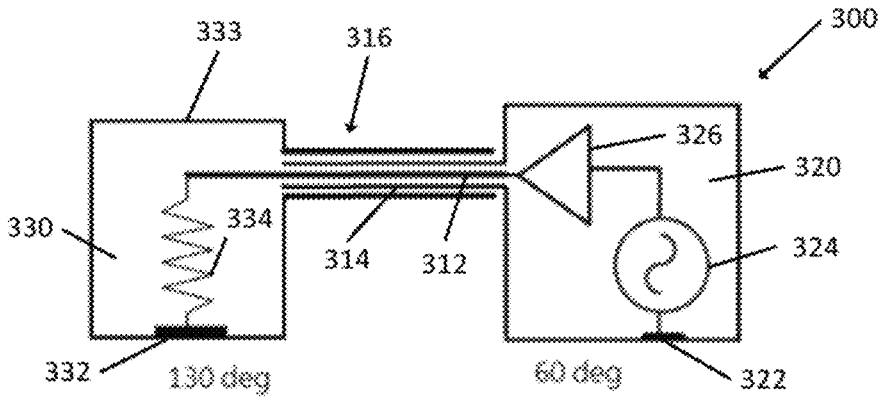
FIG. 3 is a schematic diagram showing a first example of a radio frequency system including a transmission line according to the present disclosure.

FIG. 3 shows an example radio frequency system 300 comprising a first terminal 320, a second terminal 330 and a transmission line 310 connecting the first terminal and the second terminal.

The first terminal 320 comprises a radio frequency (RF) signal source. The RF signal source comprises a RF driver 324 for generating a RF signal and may also include and an amplifier 326 for amplifying a RF signal output by the RF driver. The RF source is connected to an electrical ground 322. In some examples, the casing 323 of the first terminal may be electrically connected to the ground 322 and thus act as the electrical ground of the first terminal. The load 334 of the second terminal 330 is connected to an electrical ground 332 of the second terminal. In some examples the casing 33 of the second electrical terminal may act as the electrical ground of the second terminal.

In one example the RF system may be an electrodeless lamp, such as an electrodeless plasma lamp comprising a bulb and a light emitting gas inside the bulb. The second terminal may be a light generating unit of the electrodeless lamp and the load 334 of the second terminal may be a light conversion module of the electrodeless lamp. The first terminal may be a RF signal source of an electrodeless lamp. However, the teachings of the present disclosure are not limited to electrodeless lamps and may be applied to any system comprising a first terminal including a RF signal source and a second terminal comprising a load for receiving the RF signal. For example, instead of a lamp the second terminal may be a medical device, a RF antenna, an electrode of a welding equipment or another type of load designed to receive a RF signal.

The transmission line 310 includes an inner conductor 312, a first metal tube 314 and a second metal tube 316. The inner conductor 312 comprises a length of conductive material for electrically connecting the RF source 324 of the first terminal 320 with the load 334 of the second terminal. A RF signal may be injected into the inner conductor 312 by the RF source and conveyed by the inner conductor to the load 334. Therefore the inner conductor may be referred to as the signal conductor or the signal line.

Meanwhile, the first metal tube 314 and the second metal tube 316 together form a ground structure of the transmission line. Therefore they may be referred to as ground channel conductors. The first metal tube 314 is connected to the electrical ground 322 of the first terminal 320 and surrounds at least a part of the length of the inner conductor 312. The second metal tube is connected to an electrical ground of the second terminal 330 and surrounds at least a part of the length of the inner conductor. At least part of the second metal tube overlaps with at least part the first metal tube such that the inner conductor is not exposed to the external environment between the RF signal source and the lamp.

The above structure enables a RF signal to be propagated by the RF source into the inner conductor 312 and confined within the transmission line 310 by the first metal tube 314 and/or the second metal tube 316 in a similar manner as for a coaxial cable. As at any point along its length the inner conductor 312 is surrounded by either the first metal tube 314 or the second metal tube 316, the RF signal does not escape to the external environment. Further, in the above structure the first metal tube and the second metal tube shield the inner conductor from external electromagnetic noise in the environment.

Unlike a coaxial cable, there are two ground channel conductors 314 and 316, and each ground channel conductor is contact with only one, but not both of, the first terminal and the second terminal. Thus the first metal tube 314 is insulated from the second terminal 330 and the second metal tube 316 is insulated from the first terminal 320. In this way heat is not transferred from the second terminal 330 back to the first terminal 330. This helps to protect the RF signal source from damage, especially in applications such as discharge lamps, welding etc., where the load produces large amounts of heat. For instance, in one example, the first terminal 320 with the RF source may operate at a temperature of 60 degrees, while the second terminal 330 with the load may reach a temperature of 130 degrees. However, due to the structure of the transmission line the first terminal is thermally isolated from the second terminal and so this temperature difference may be maintained.

In the example of FIG. 3, the first metal tube 314 extends inside the second metal tube 316. Therefore, the first metal tube 314 may be referred to as the middle conductor and the second metal tube 316 may be referred to as the outer conductor. The inner conductor 312 is electrically insulated from the middle and outer conductors 314, 316 which act as electrical grounds to confine the signal within the transmission line. The outer conductor 316 is thermally and electrically insulated from the middle conductor 314. Furthermore, the outer conductor 316 extends along substantially the entire length of the middle conductor 314. In this context, extends substantially the entire length means at least 80% of the entire length. Thus the outer conductor 316 extends along at least 80% of the length of the middle conductor 314. In some implementations it may be at least 90% of the length. As a result of this structure the middle conductor 314 and thus the RF source are shielded from electrical and thermal disturbances in the external environment. This is helps to prevent damage to the RF source which may be a sensitive piece of equipment.

Figure 4:
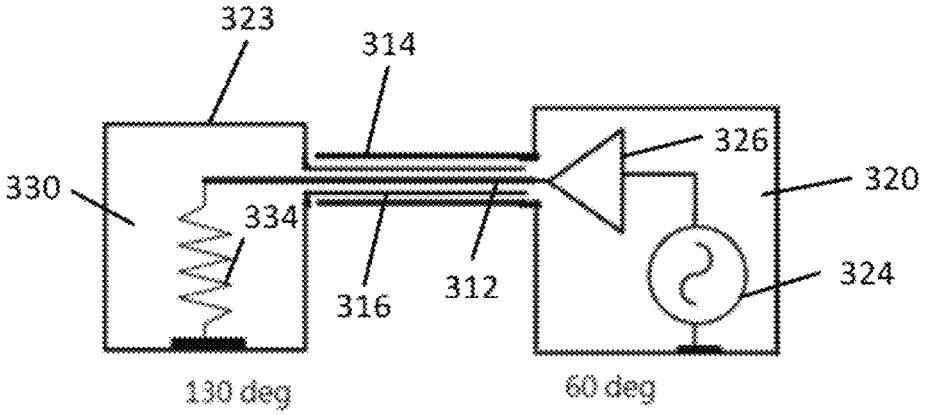
FIG. 4 is a schematic diagram showing a second example of a radio frequency system including a transmission line according to the present disclosure.
Figure 5:
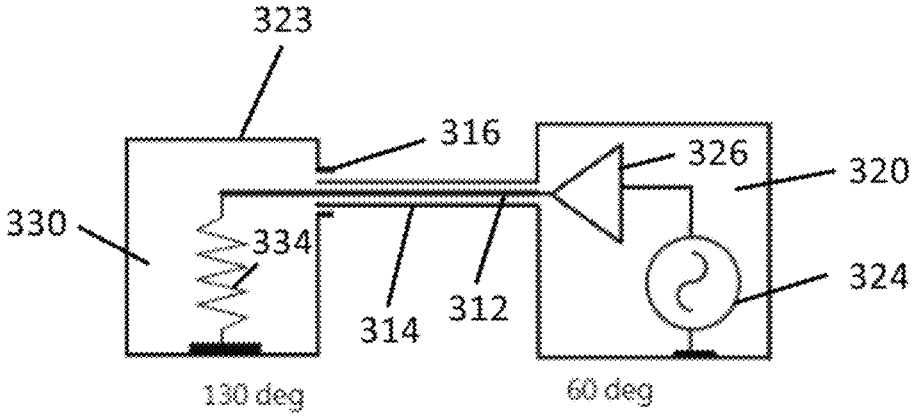
FIG. 5 is a schematic diagram showing a third example of a radio frequency system including a transmission line according to the present disclosure.
Figure 6:
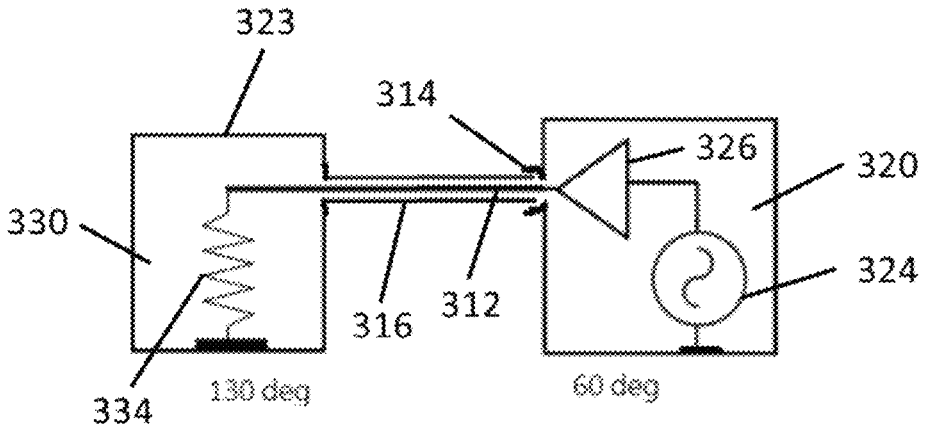
FIG. 6 is a schematic diagram showing a fourth example of a radio frequency system including a transmission line according to the present disclosure.

FIGS. 4 to 6 shows further examples of RF systems and transmission lines, which are similar to FIG. 3 and in which like reference numerals denote like parts. All of these examples include a first metal tube 314 which is connected to the electrical ground of the first terminal (but not connected to the second terminal), and a second metal tube which is connected to the electrical ground of the second terminal (but not connected to the first terminal). However the relative lengths and/or positions of the first metal tube 314 and second metal tube 316 vary between the different examples.

In FIG. 4 the first metal tube 314 is the outer conductor and second metal tube 316 is the middle conductor. Thus the second metal tube 316 extends inside the first metal tube 314. The first metal tube 314 surrounds substantially the entire length of the second metal tube 316. In this way the second metal tube is shielded from external electrical and thermal disturbances and such disturbances are not transmitted by the second metal tube to the second terminal. In this context surrounds substantially the entire length means at least 80% of the length. Thus the first metal tube 314 surrounds at least 80% of the length of the second metal tube 316. In some implementations it may be at least 90% of the length.

FIG. 5 is similar to FIG. 3, except that the second metal tube 316 is relatively short. Thus the second metal tube surrounds only a small section of the length of the first metal tube 314. As with FIGS. 3 and 4 there is still an overlap between the first metal tube and the second metal tube, such that the inner conductor is not exposed to the external environment. However, in the arrangement of FIG. 5, the majority of the length of the first metal tube 314 is exposed to the external environment. In this context the majority of the length means at least 50% of the length. In some examples at least 80% or at least 90% of the length of the first metal tube may be exposed to the external environment.

In FIGS. 4 and 5 thermal or electrical disturbances from the environment may be transmitted to the first terminal 320 by the first metal tube 314. However, heat generated by the second terminal 330 will not be transmitted to the first terminal as the first metal tube is thermally insulated from the second terminal. While heat could be transmitted over the inner conductor, in practice the capacity of the inner conductor to transmit heat is limited due to its small size.

FIG. 6 is similar to FIG. 4, except that the first metal tube 316 is relatively short. Thus the second metal tube 316 surrounds only a small section of the length of the first metal tube 314. As with FIGS. 3 and 4 there is still an overlap between the first metal tube and the second metal tube, such that the inner conductor is not exposed to the external environment. Further as the second metal tube is not in conductive contact with the first terminal, heat from the first terminal or heat and electric disturbances from the external environment are not transmitted via the second metal tube to the first terminal. In the arrangement of FIG. 6, the majority of the length of the first metal tube 314 is exposed to the external environment. In this context the majority of the length means at least 50% of the length. In some examples at least 80% or at least 90% of the length of the first metal tube may be exposed to the external environment.

The first metal tube 314 may be connected to the first terminal 320 by a connector at an end of the first metal tube. The second metal tube 316 may be connected to the second terminal 330 by a connector at an end of the second metal tube. The connectors may be any suitable connector, for example a screw connector, snap fit connector or flange connector.

The configurations shown in FIGS. 3 to 6 may be expressed in general terms as follows. A middle conductor is connected to an electrical ground of one of the first terminal and the second terminal. That is the middle conductor is connected to the electrical ground of either the first terminal or the second terminal. Meanwhile, the outer conductor is connected to the electrical ground of the other one of the first and second terminals. Thus if the middle conductor is connected to the electrical ground of the first terminal, the outer conductor is connected to the electrical ground of second terminal. However, if the middle conductor is connected to the electrical ground of the second terminal, then the outer conductor is connected to the electrical ground of the first terminal.

In the above examples, the first metal tube 314 and the second metal tube 316 are not in direct electrical contact. Therefore from a direct current perspective the ground of the first terminal and the ground of the second terminal are separate. However, where the first metal tube 314 and the second metal tube 316 overlap, the first metal tube may be capacitively coupled to the second metal tube 316. This has the effect of linking the grounds of the first terminal and the second terminal from an alternating current perspective. By controlling the length of the transmission line and the gap distance between the first metal tube and the second metal tube, a low transmission loss for a narrow band of frequencies may be achieved. This is discussed later with reference to FIG. 12.

As will be clear from the above, the inner conductor, middle conductor and outer conductor may be thermally and electrically insulated from each other. In some examples they may extend coaxially with each other. Examples of possible arrangements for supporting the conductors in a co-axial arrangement and/or insulating the conductors from each other will now be described.

Figure 7A:
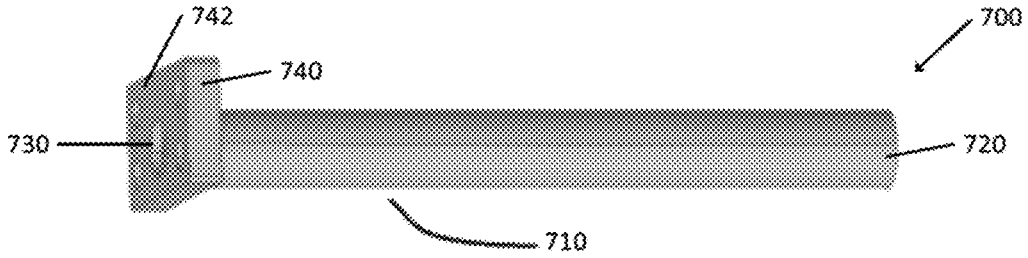
FIG. 7A shows an example of an outer conductor of a transmission line according to the present disclosure.

FIG. 7A shows an example of an outer conductor 700, which may for instance be used as the second metal tube 316 in FIG. 3. The outer conductor 700 comprises a main tube section 710. In this example the tube is circular in cross section, but in other examples different cross sectional shapes could be used. The tube 710 has an aperture 730 at a first end an aperture 720 at a second end and may be hollow between these two ends. The first end of the outer conductor has a connector 740 for connection to the second terminal. In this example, the connector 740 comprises a flange with apertures 742 by which the flange can be screwed of otherwise affixed to the second terminal. However, any suitable type of connector may be used depending upon the connecting features of the second terminal.

Figure 7B:
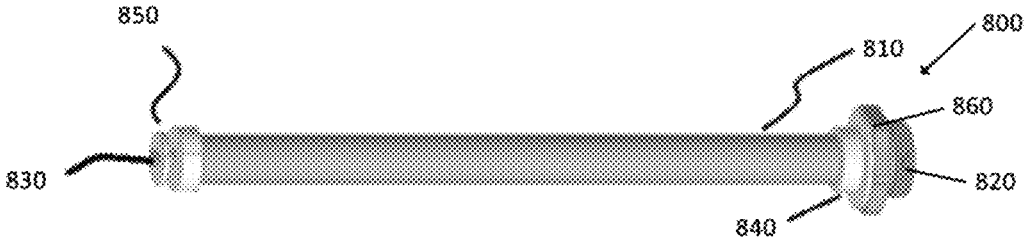
FIG. 7B shows an example of a middle conductor of a transmission line according to the present disclosure.

FIG. 7B shows an example of a middle conductor 800, which may for instance be used as the first metal tube 314 in FIG. 3. The middle conductor 800 comprises a main tube section 810. The circumference of the middle conductor 800 is less than the circumference of the outer conductor 700, such that the tube 810 of the middle conductor may fit inside the tube 710 of the outer conductor. In this example the tube is circular in cross section, but in other examples different cross sectional shapes could be used. The tube 810 is hollow and has an aperture 830 at a first end an aperture 820 at a second end through which the inner conductor 312 (not shown in FIG. 7B) may extend. The first end of the middle conductor 800 comprises a connector 840 for connecting the middle conductor with a ground of the first terminal. In this example the connector 840 is a screw type connector, but other types of connector may be used depending upon the connection interface of the first terminal.

Figure 8A:
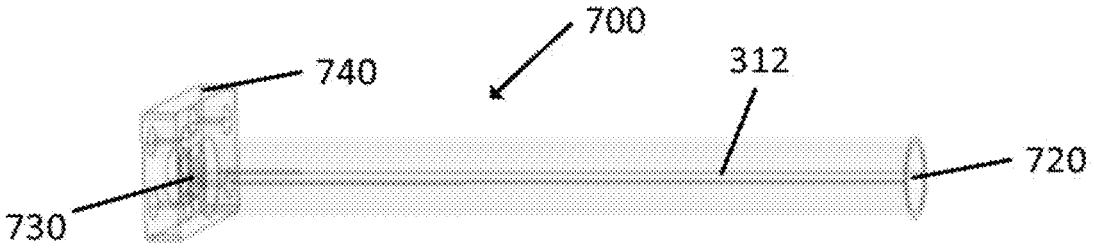
FIG. 8A shows an example structure of the outer conductor in more detail.
Figure 8B:
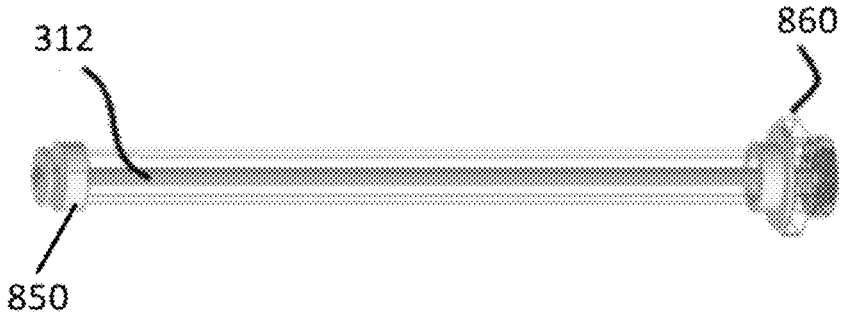
FIG. 8B shows an example structure of the middle conductor and an inner conductor in more detail.

FIG. 8A shows an internal structure of the outer conductor 700 of FIG. 7A and in particular shows how an inner conductor 312 may extend within the outer conductor 700. FIG. 8B shows an internal structure of the middle conductor 800 of FIG. 7B and in particular shows how an inner conductor 312 may extend within the middle conductor 800.

Figure 9:
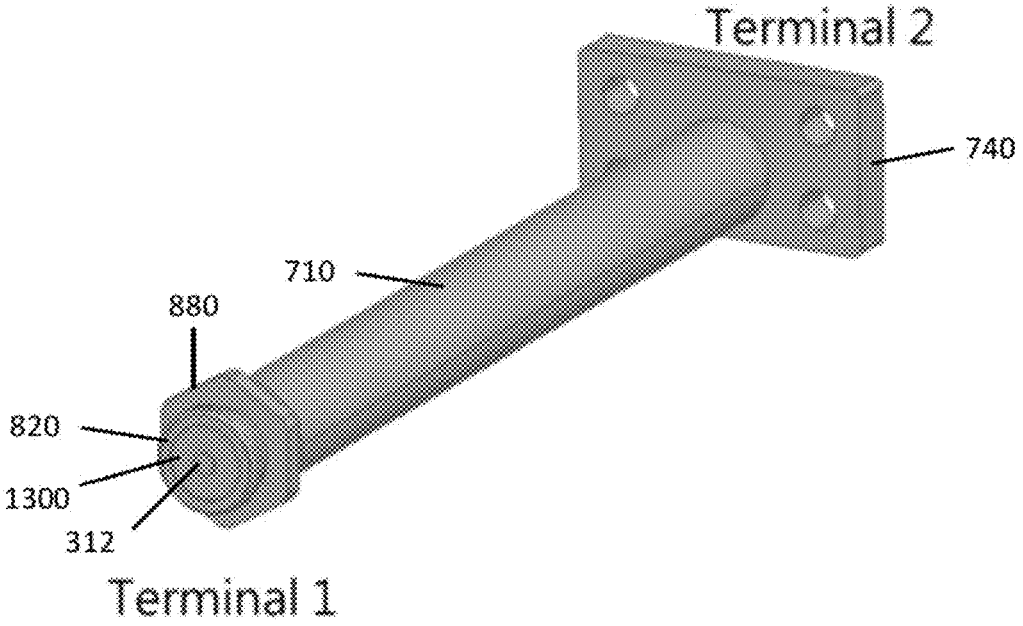
FIG. 9 is a perspective view of a transmission line according to the present disclosure.

The inner conductor 312, middle conductor 800 and outer conductor 700 may be assembled together as shown in FIG. 9. The inner conductor 312 is positioned inside the middle conductor 700 and the middle conductor is positioned inside the outer conductor 800. The inner conductor, middle conductor and outer conductor may extend coaxially and non-conductive supports may be used to support them in position relative to each other.

In the following discussion it is assumed the transmission line of FIG. 9 is used to implement the configuration of FIG. 3, i.e. the first middle conductor 800 corresponds to the first metal tube 314 in FIG. 3 and is fixed to the first terminal, while the outer conductor 700 corresponds to the second metal tube 316 in FIG. 3 and is fixed to the second terminal.

However, it would be possible to implement the arrangement of FIG. 4 simply by attaching the transmission line the other way around so that the outer conductor 700 was fixed to the first terminal and the middle conductor fixed to the second terminal.

In either case, there is no direct electrical connection between the ground of the first terminal and the ground of the second terminal. The middle conductor 700 (i.e. first metal tube 314 in FIG. 3 arrangement) extends along substantially the whole length of the transmission line as does the outer conductor 800, but each of them is electrically connected to only one of the terminals. In this context substantially the whole length means at least 80% of the whole length. In some implementations it may be at least 90% of the length.

The first terminal may be insulated from the first metal tube and the second terminal may be insulated from the second metal tube by an air gap. However, insulators formed of a solid insulating material such as plastic, rubber or PTFE etc may be used to enhance the degree of insulation and/or mechanical stability. For instance, a first insulator 850 may be used for insulating the first metal tube from the second terminal and a second insulator 860 may be used for insulating the second metal tube from the first terminal.

FIGS. 7B and 8B show an example in which a gasket 850 acts as a first insulator to insulate the first metal tube from the second terminal and a gasket 860 acts as a second insulator to insulate the second metal tube from the second terminal. The gaskets 850, 860 may also act to support the inner 312, middle 800 and outer 700 conductors relative to each other, for example in a coaxial arrangement.

The gaskets 850, 860 may be formed of a non-conductive, electrically and thermally insulating material. The gasket 850 may include a rim against which an end of the tube 810 of the first metal tube abuts to prevent contact of the first metal tube with the second terminal. The gasket 850 may also have an edge which acts as a support to position the first metal tube within the second metal tube. The gasket 850 may further include a portion which supports the inner conductor 312 within the first metal tube. The gasket 860 may include a rim against which an end of the tube 710 of the second metal tube abuts to prevent contact of the second metal tube with the first terminal. The gasket 850 may also have an edge which acts as a support to position the first metal tube within the second metal tube.

Figure 10:
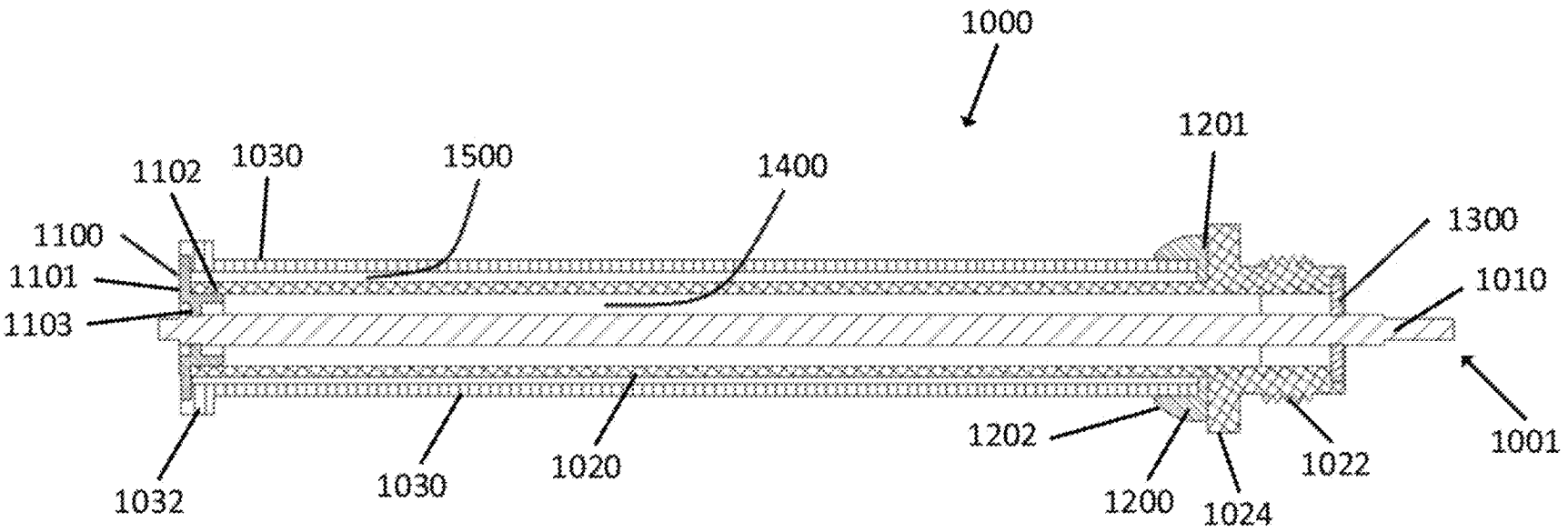
FIG. 10 is a cross sectional view of a transmission line according to the present disclosure showing how the inner conductor, middle conductor and outer conductor fit together.

FIG. 10 is a cross sectional view of a transmission line 1000 according to the present disclosure. It includes an inner conductor 1010, a middle conductor 1020 and an outer conductor 1030. The first end of the transmission line 1001 is to be connected to a first terminal and the second end of the transmission line 1002 is to be connected to a second terminal.

The first conductor 1010 is in the form of a length of conductive material such as, but not limited to, copper. It may take the form of a rod or cable. The middle conductor 1020 is in the form of a metal tube and surrounds substantially the entire length of the first conductor 1010. The outer conductor 1030 is in the form of a metal tube and surrounds substantially the entire length of the middle conductor 1020. In this context substantially the entire length means at least 80% of the whole length. In some implementations it may be at least 90% of the length.

A first end of the middle conductor 1020 has a connector 1022 for connection to a first terminal (e.g. a RF source 320 as shown in FIG. 3). The connector in this example is a screw thread, but in other examples may be any other type of suitable connector. The connector 1022 of the middle conductor may connect with an electrical ground of the first terminal, such as a casing of the first terminal.

A first end of the outer conductor 1030 has a connector 1032 for connection with a second terminal (e.g. a load 330 as shown in FIG. 3). In this example the connector 1032 is a flange, but in other examples other types of connector may be used. The connector 1032 of the outer conductor may connect with an electrical ground of the second terminal, such as casing of the second terminal.

If the transmission line 1000 is used in the arrangement shown in FIG. 3, the middle conductor 1020 may be termed the first metal tube as it is for connection with the first terminal and the outer conductor 1030 may be termed the second metal tube as it is for connection with the second terminal.

A first insulator 1100 is provided at the second end of the transmission line and insulates the first metal tube 1020 from the second terminal. The first insulator may be formed from a plastic, PTFE or any other suitable non-conductive, electrically and thermally insulating material. The first insulator 1100 may be in the form of a gasket shaped to support the first metal tube within the second metal tube. The first insulator may comprise a rim section 1101 for insulating the first metal tube from the second terminal. A second end of the first metal tube may abut against the rim section 1101.

A second insulator 1200 is provided at the second end of the transmission line and insulates the second metal tube 1030 from the first terminal. The second insulator 1200 may be formed from a plastic, PTFE or any other suitable non-conductive, electrically and thermally insulating material. The second insulator 1100 may be in the form of a gasket and may fit around the outside of the first metal tube 1020. The second insulator may comprise a rim section 1201 for insulating the second metal tube 1030 from the second terminal. A second end of the second metal tube may abut against the rim section 1201.

The first metal tube 1020 is insulated from the inner conductor 1010 by an air gap 1400 between the first metal tube 1020 and the inner conductor 1010. Likewise the first metal tube 1020 is insulated from the second metal tube 1030 by an air gap 1500 between the first metal tube 1020 and the second metal tube 1030. Using an air gap rather than a solid material to insulate the inner, middle and outer conductors from each other reduces the expense and weight of the transmission line. Furthermore such an arrangement may be simple to manufacture by using gaskets or other insulating supports to support the first and second metal tubes and the inner conductor in position relative to each other.

The first insulator 1100 acts as an electrically insulating support for supporting the first metal tube 1020 in a position concentric with the second metal tube 1030. The first insulator 1100 may have a ledge portion 1102 for supporting the first metal tube. The second insulator 1200 acts as an electrically insulating support for supporting the second metal tube 1030 in a position coaxial with the first metal tube 1020. The second insulator 1200 may have a projecting portion 1202 for supporting the second metal tube.

The first insulator 1100 also supports the inner conductor 1010 in a position concentric with the first metal tube 1020. A third insulator 1300 may be provided at the first end 1001 of the transmission line and may support the inner conductor 1010 in a position concentric with the first metal tube 1020.

Thus the first insulator, second insulator and third insulator may be shaped to support the first metal tube, second metal tube and inner conductor in fixed positions relative to each other, for example such that the metal tubes and inner conductor are coaxial with each other. The insulators may be referred to as non-conductive supports. The first insulator 1100 and the third insulator 1300 help keep the inner conductor in position and between the first insulator 1100 and the third insulator 1300 the inner conductor 1010 is insulated from the first metal tube 1020 by the air gap 1400. Likewise the first insulator 1100 and the second insulator 1200 help keep the first metal tube 1020 in position relative to the second metal tube 1030. Between the first insulator 1010 and the second insulator 1020 the first metal tube is insulated from the second metal tube by the air gap 1500.

In the example of FIG. 10 the first and second insulators 1100, 1200 perform the dual function of insulating the first and second metal tubes from the terminals and supporting the first and second metal tubes in position to maintain the air gap and thus the insulation between them. However, in other examples separate insulators or gaskets could be used for these different functions. Further, while the insulators in FIG. 10 support the first and second metal tubes and the inner conductor near the ends thereof, in other examples the supports could be in different locations and need not necessarily be at the ends of the transmission line.

Figure 11:
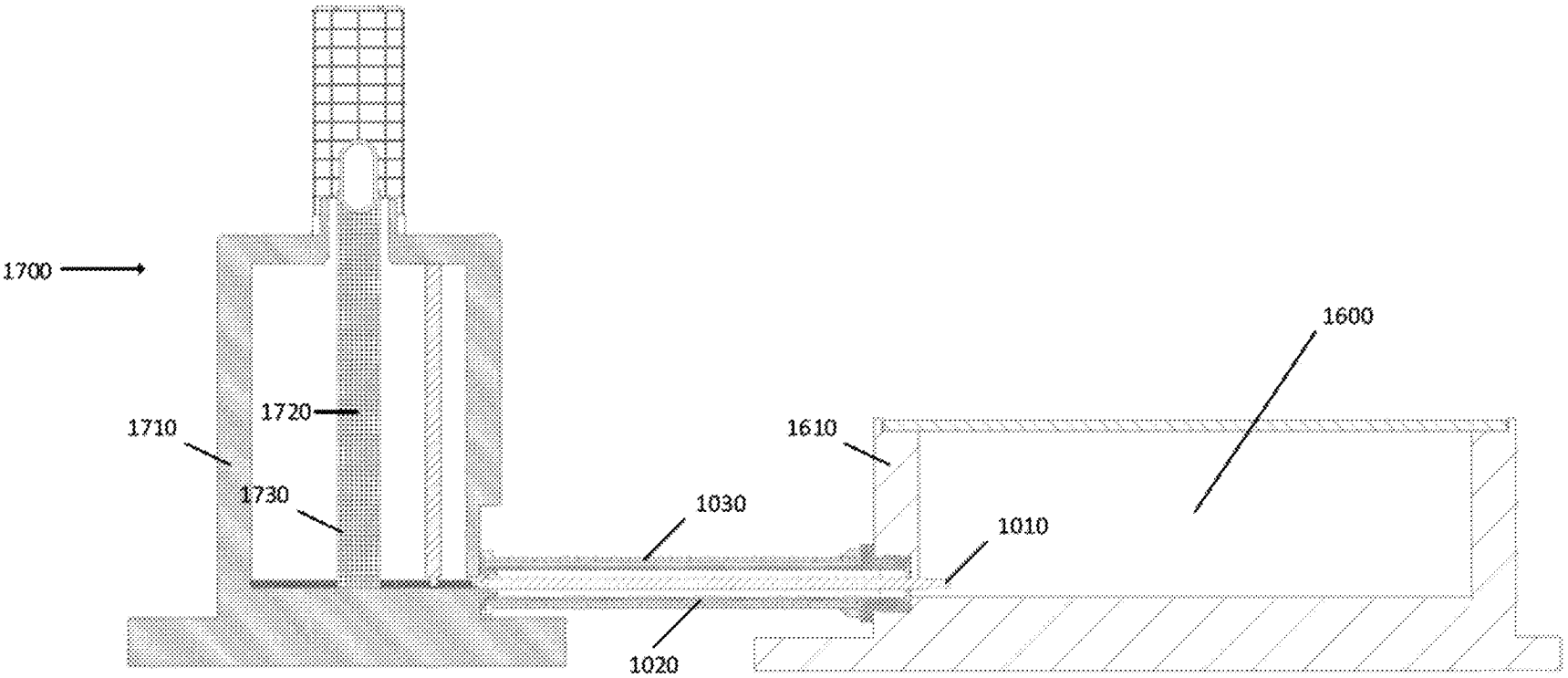
FIG. 11 is a schematic view of a electrodeless discharge lamp comprising a lamp, transmission line and RF source according to the present disclosure.

FIG. 11 shows an example of the transmission line 1000 of FIG. 10 used in an electrodeless lamp to connect a RF source 1600 to a lamp portion 1700 of the lamp. Thus the RF source 1600 acts as a first terminal of a RF system, while the lamp 1700 acts as a second terminal of the RF system. The lamp 1700 includes a casing 1710 which acts as an electrical ground, a gas containing chamber 1720 inside the casing and a coil 1730 which acts as a load. When a RF frequency signal is applied to the coil 1730 this excites the gas into a plasma and causes illumination due to high intensity discharge. The RF source 1600 comprises a casing 1610 which acts as an electrical ground of the RF source. The transmission line 1000 connects the RF source 1600 with the lamp 1700 and is used to convey a RF signal from the RF source to the coil 1730 which acts as the load of the lamp.

Whereas a conventional coaxial line has a wide transmission band, the transmission line of the present disclosure with inner conductor, first metal tube and second metal tube, may be designed to have a relatively narrow transmission band. This is due to the effect of coupling between the first metal tube 314 and the second metal tube 316.

Figure 12:
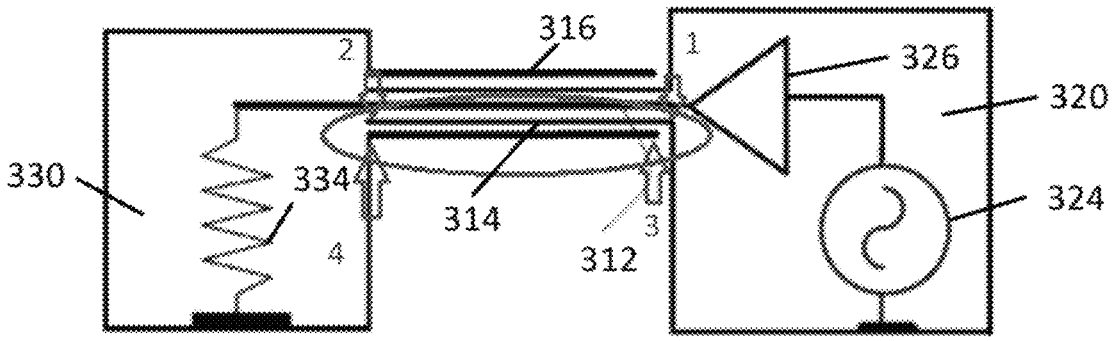
FIG. 12 is a schematic diagram showing how the ground structure of the transmission line of FIG. 3 may be modelled as a directional coupler.

The coupling between the first metal tube 314 and second metal tube 316 may be modelled as a coupled line directional coupler, as shown in FIG. 12. A directional coupler is a four port circuit in which a signal input on a main line between ports 1 and 2 may be coupled to another signal path (the "coupled line") between ports 3 and 4. If the ground structure provided by the first metal tube 314 and the second metal tube 316 is modelled as a directional coupler, then ports 2 and 3 would be open ended ports and therefore the majority of the signal would be coupled to port 4. Thus in this arrangement the majority of the signal in the ground structure would be transmitted to the ground of the second terminal.

When coupled line directional couplers are implemented on a microstrip, the width of the main line, the width of the coupled line, and the gap between the main line and the coupled line, together determine the characteristic impedance of the transmission path and the coupling factor between the main and coupled lines. However, in the present disclosure, the coupling structure is on the ground path instead of the signal path. Therefore, the dimensions of the two coupling elements—i.e. the first metal tube and the second metal tube do not significantly affect the characteristic impedance of the transmission line. Instead the characteristic impedance is mainly controlled by the ratio of the outside diameter of the inner conductor 312 and the inside diameter of the middle conductor which is the first metal tube 314.

Accordingly, as the dimensions of the ground coupling elements 314 and 316 have no major effect on the characteristic impedance of the transmission line, the performance of the transmission line is determined mainly by the length of the coupling section and the gap distance between the first metal tube and the second metal tube in the overlapping section. As confirmed by experiments, the smaller the gap distance, the better is the coupling factor, and thus the lower insertion loss. Therefore the transmission is better when the gap distance between the first metal tube and the second metal tube, i.e. the difference in diameter of the tubes is small, e.g. 0.1 mm-2 mm.

The length of the coupling section is the length of the overlap between the first metal tube and the second metal tube. In the examples of FIG. 3, FIG. 4 and FIGS. 10 and 11 the length of the coupling section is almost the whole length of the transmission line. The length of the coupling section has the same effect on the coupling frequency for the transmission line as in the case of a "coupled line directional coupler". That is coupling loss is at a minimum when the coupling section length is equal to one quarter of the wavelength of the transmitted signal. Thus the overlapping section should have a length substantially equal to Lambda/4, where Lambda is the wavelength of the signal from the RF source which is to be used with the transmission line. In this context substantially equal means within a margin of error, e.g. +/−5%.

The invention claimed is:

1. A transmission line for conveying a radio frequency (RF) signal between a first terminal and a second terminal, the transmission line comprising:

an inner conductor comprising a length of conductive material having a first end for electrical connection with the first terminal and a second end for electrical connection with the second terminal;

a first metal tube surrounding at least a part of the length of the first conductor, extending co-axially with the inner conductor and comprising a connector for connecting a first end of the first metal tube with a ground of the first terminal;

a second metal tube surrounding at least a part of the length of the inner conductor, extending co-axially with the inner conductor and the first metal tube and comprising a connector for connecting a first end of the second metal tube with a ground of the second terminal;

a first insulator for insulating the first metal tube from the second terminal; and a second insulator for insulating the second metal tube from the first terminal.

2. The transmission line of claim 1, wherein the first metal tube is insulated from the inner conductor by an air gap.

3. The transmission line of claim 1, wherein the second metal tube is insulated from the first metal tube by an air gap.

4. The transmission line of claim 1, wherein the first insulator is a gasket shaped to support the first metal tube within the second metal tube.

5. The transmission line of claim 4, wherein the first insulator supports the inner conductor within the first metal tube.

6. The transmission line of claim 1, wherein the second insulator is shaped to support the second metal tube in a fixed position relative to the first metal tube.

7. The transmission line of anyone of claim 1, comprising a third insulator for supporting the inner conductor within the first metal tube at a first end of the first metal tube.

8. An electrodeless plasma lamp comprising:

a radio frequency (RF) signal source, a lamp comprising a bulb and a light emitting gas inside the bulb, a transmission line for conveying a RF signal from the RF signal source to the lamp, the transmission line comprising:

an inner conductor comprising a length of conductive material for electrically connecting the radio frequency signal source with the lamp;

a first metal tube connected to an electrical ground of the RF signal source and surrounding at least a part of the length the inner conductor and;

a second metal tube connected to an electrical ground of the lamp and surrounding at least a part of the length of the inner conductor;

wherein at least part of the second metal tube overlaps with at least part the first metal tube such that the inner conductor is not exposed to the external environment between the RF signal source and the lamp and wherein the first metal tube is insulated from the second metal tube, the first metal tube is insulated from the lamp and the second metal tube is insulated from the RF signal source.

9. The electrodeless lamp of claim 8, wherein the first metal tube extends inside the second metal tube.

10. The electrodeless lamp of claim 9, wherein the second metal tube extends along substantially the entire length of the first metal tube so as to shield the first metal tube from the external environment.

11. The electrodeless lamp of claim 8, wherein the first metal tube is insulated from the second metal tube by an air gap between the first metal tube and the second metal tube.

12. The electrode less lamp of claim 8, comprising an electrically insulating support for supporting the first metal tube in a position concentric with the second metal tube.

13. The electrodeless lamp of claim 8, wherein the first metal tube is insulated from the inner conductor by an air gap between the first metal tube and the inner conductor.

14. The electrode less lamp of claim 8, comprising an electrically insulating support for supporting the inner conductor in a position concentric with the first metal tube.

15. The electrodeless lamp of claim 8, wherein the first metal tube is capacitively coupled to the second metal tube.

16. The electrodeless lamp of claim 15, wherein a gap distance between the second metal tube and the first metal tube, in a region where the second metal tube overlaps the first metal tube, is less than 2 mm.

17. A radio frequency system comprising:

a first terminal comprising a radio frequency (RF) signal source;

a second terminal comprising a load;

a transmission line connecting the first terminal with the second terminal, wherein the transmission line comprises:

an inner conductor comprising a length of conductive material for electrically connecting the RF source of the first terminal with the load of the second terminal;

a middle conductor connected to an electrical ground of one of the first terminal and the second terminal, the middle conductor surrounding at least part of the length of the inner conductor; and an outer conductor connected to an electrical ground of the other of the first terminal and the second terminal, the outer conductor surrounding at least part of the length of the inner conductor;

wherein the inner conductor is electrically insulated from the middle conductor and the outer conductor; and wherein the outer conductor is thermally insulated from the middle conductor.

18. The system of claim 17, wherein the middle conductor extends along substantially all of the length of the transmission line from the first terminal to the second terminal, but is not in electrical contact with the second terminal.

19. The system of claim 17, wherein the middle conductor is supported within the outer conductor by a first non-conductive support and a second non-conductive support and between the first and second non-conductive supports there is an air gap between the outer conductor and the middle conductor.

20. The system of claim 17, wherein a length of an overlap section in which the middle conductor overlaps with the outer conductor is substantially equal to a wavelength of the RF signal source.

* * * * *